US010557634B2

(12) United States Patent
Norster et al.

(10) Patent No.: US 10,557,634 B2
(45) Date of Patent: Feb. 11, 2020

(54) METHOD FOR OPERATING A PREMIX BURNER, AND A PREMIX BURNER FOR CARVING OUT THE METHOD

(75) Inventors: Eric Norster, Nottingshamshire (GB); Holger Huitenga, Muelheim (DE); Reiner Brinkmann, Duisburg (DE)

(73) Assignee: MAN Energy Solutions SE, Augsburg (DE)

( * ) Notice: Subject to any disclaimer, the term of this patent is extended or adjusted under 35 U.S.C. 154(b) by 1237 days.

(21) Appl. No.: 12/988,152

(22) PCT Filed: Nov. 3, 2008

(86) PCT No.: PCT/EP2008/009256

§ 371 (c)(1),
(2), (4) Date: Apr. 5, 2011

(87) PCT Pub. No.: WO2009/127240

PCT Pub. Date: Oct. 22, 2009

(65) Prior Publication Data

US 2011/0167832 A1 Jul. 14, 2011

(30) Foreign Application Priority Data

Apr. 16, 2008 (DE) ..... 10 2008 019 117

(51) Int. Cl.
*F23R 3/28* (2006.01)
*F23R 3/34* (2006.01)

(52) U.S. Cl.
CPC ..... *F23R 3/286* (2013.01); *F23R 3/343* (2013.01); *F23D 2900/00008* (2013.01); *F23D 2900/00015* (2013.01); *F23D 2900/14003* (2013.01)

(58) Field of Classification Search
CPC .. F23R 3/343; F23R 3/14; F23R 3/283; F23R 3/286; F23D 2900/03343; F23D 2900/00008; F23D 2900/00015; F23D 2900/00014; F02C 7/222; F02C 7/26
USPC ..... 60/39.826, 776, 737, 739, 748, 742; 431/12, 284, 278
See application file for complete search history.

(56) References Cited

U.S. PATENT DOCUMENTS

| | | | | |
|---|---|---|---|---|
| 4,589,260 | A * | 5/1986 | Krockow | 60/737 |
| 5,452,574 | A | 9/1995 | Cowell et al. | |
| 6,532,726 | B2 * | 3/2003 | Norster et al. | 60/39.281 |
| 2003/0074885 | A1 | 4/2003 | Rokke | |
| 2006/0101814 | A1 | 5/2006 | Saitoh et al. | |

(Continued)

FOREIGN PATENT DOCUMENTS

| | | |
|---|---|---|
| DE | 199 03 770 | 9/1999 |
| DE | 696 17 290 | 6/2002 |

(Continued)

OTHER PUBLICATIONS

Francis, N.A., "Investigation of fuel nozzle technologies to reduce gas turbine emissions", 2015, 4 pages.

(Continued)

*Primary Examiner* — Andrew H Nguyen
(74) *Attorney, Agent, or Firm* — Cozen O'Connor

(57) ABSTRACT

A method for operating a premix burner for gaseous fuels having a multi-stage pilot gas system whose diffusion fuel is injected into a flame chamber of the premix burner as at least two partial streams with different orientations, and a premix burner for carrying out the method.

14 Claims, 1 Drawing Sheet

(56) References Cited

U.S. PATENT DOCUMENTS

| | | | | |
|---|---|---|---|---|
| 2006/0183069 | A1 | 8/2006 | Bernero et al. | |
| 2006/0191268 | A1 | 8/2006 | Widener et al. | |
| 2007/0026353 | A1 | 2/2007 | Eroglu et al. | |
| 2007/0234735 | A1* | 10/2007 | Mosbacher et al. | 60/780 |
| 2008/0041060 | A1* | 2/2008 | Nilsson et al. | 60/737 |

FOREIGN PATENT DOCUMENTS

| | | |
|---|---|---|
| DE | 103 34 228 | 3/2004 |
| DE | 102005054442 | 5/2006 |
| DE | 601 15 773 | 7/2006 |
| DE | 10 2005 015 152 | 10/2006 |
| EP | 1 614 967 | 1/2006 |
| EP | 1 645 802 | 4/2006 |
| EP | 1 734 306 | 12/2006 |
| FR | 27 88 109 | 7/2000 |
| JP | 2003-522929 | 7/2003 |
| WO | WO 01/59369 | 8/2001 |
| WO | WO 08 052830 | 5/2008 |
| WO | WO 2008 052830 | 5/2008 |

OTHER PUBLICATIONS

Arai et al. "Characteristics and applications of Hitachi H-25 gas turbine", Hitachi Review, vol. 57, 2008, pp. 279-27.

Parker Aerospace, "Fluid atomization innovation-Improving your performance, delivering greater value", 2010, 12 pages.

* cited by examiner

METHOD FOR OPERATING A PREMIX BURNER, AND A PREMIX BURNER FOR CARVING OUT THE METHOD

PRIORITY CLAIM

This is a U.S. national stage of application No. PCT/EP2008/009256, filed on Nov. 3, 2008. Priority is claimed on the following application: Country: Germany, Application No.: 10 2008 019 177.5, Filed: Apr. 16, 2008, the contents of which are incorporated here by reference.

FIELD OF THE INVENTION

The invention is directed to a method for operating a premix burner and to a premix burner for carrying out the method.

BACKGROUND OF THE INVENTION

To reduce harmful emissions, combustion processes which are spark-ignited but which are then self-running are frequently operated in gas turbines by a main-flow fuel system or a main injection with a lean gas-air mixture generated outside the respective flame chamber. However, the lean gas-air mixture results in a narrow stability range in the respective combustion process. The narrower the stability range, the more susceptible the combustion process to changing operating conditions, which can result in an unintentional termination of the combustion process. For purposes of stabilizing the combustion process, known premix burners have a pilot gas system by which a pilot flame is formed in the flame chamber from a fuel that is not premixed. Apart from stabilizing the combustion process, the pilot flame often also ignites the respective combustion process. Consequently, it is positioned in the vicinity of an ignition orifice of the premix burner. In so doing, stabilization of the combustion process is given priority over harmful emissions.

A premix burner for gaseous fuels and a method for controlling this premix burner are shown in DE 10 2005 054 442 A1. This premix burner has a multi-stage main injector with a plurality of main nozzles for injecting a gas-air mixture into a flame chamber and a central pilot gas system. In order to ignite the gas-air mixture, a pilot flame is formed by the pilot gas system from unmixed main fuel. Only a defined quantity of main nozzles are opened from the start until a predetermined load ratio. When falling below or exceeding a predetermined load ratio, additional main nozzles are switched on or main nozzles which are already operating are increased, respectively.

Another premix burner for gas turbines and a method for operating a premix burner of this kind are described in DE 103 34 228 A1. This premix burner for gaseous fuels has a main injector and a central multi-stage pilot gas system. The main injector has a group of main nozzles for injecting a premixed main fuel. The central multi-stage pilot gas system has a group of diffusion nozzles for injecting unmixed diffusion fuel and an independently controllable group of premix nozzles for additional injection of premixed main fuel.

When the premix burner is ignited, the greater portion of fuel is introduced by the diffusion stages of the pilot gas system. As the load increases, the premix nozzles of the pilot gas system and the main nozzles of the main injector are switched on. The diffusion nozzles are reduced. At full load, the premix nozzles and main nozzles are fully operated and the diffusion nozzles are reduced to a minimum of the total mass flow of fuel.

This method has the disadvantage that the stability range of the combustion process is not substantially enlarged in spite of the multi-stage pilot gas system. Further, a complicated control of the fuel supply is necessary and the premix burner reacts sensitively to changing fuel compositions.

SUMMARY OF THE INVENTION

It is an object of the present invention to provide a method for operating a premix burner for gaseous fuels that is more stable under changing ambient conditions and can be easily adapted to changing fuel compositions and fuel qualities, and a premix burner for carrying out a method of this kind.

In the method according to one embodiment of the invention, a gas-air mixture is injected by a main injector into a flame chamber as main fuel via a swirler. A diffusion fuel of a central pilot gas system is injected into the flame chamber in the form of at least two partial streams with different directions or orientations.

The injection of the diffusion fuel according to the invention as at least two partial streams with different orientations causes an effect similar to a premixing. At the same time, a combustion process with the injection according to the invention shows a substantially improved stability and increased flexibility under varying fuel compositions and fuel qualities.

In a preferred embodiment example, the first partial stream is injected transverse or perpendicular to the flow direction of a main fuel flow forming in the flame chamber. The second partial stream is injected in the flow direction of the main fuel flow. The first partial stream transverse to the flow direction of the main fuel flow causes an effect similar to a premixing. The second partial stream in the flow direction of the main fuel flow shows less swirling and less mixing than the first partial stream transverse to the flow direction so that the proportion of diffusion fuel in the flow direction is less sensitive to changes and the respective combustion process runs in a more stable manner.

The gas-air mixture of the main injector is preferably introduced radially into the flame chamber.

In one embodiment, the gas-air ratio of the main fuel is controlled by the air supply and not by turning the main fuel nozzles on or off.

A premix burner according to the invention for gaseous fuels has a flame chamber, a main injector for injecting a gas-air mixture as main fuel into the flame chamber, a swirler for swirling the main fuel, and a central pilot gas system arranged in the burner bottom for injecting a diffusion fuel. According to one embodiment of the invention, the pilot gas system is constructed so as to have multiple stages with at least one axial diffusion nozzle for injecting a first partial stream of the diffusion fuel and one or more diffusion nozzles which are arranged at an inclination to the longitudinal axis of the burner for injecting a second partial stream.

In one embodiment, the at least one inclined diffusion nozzle is inclined in the flow direction of the main fuel flow.

A plurality of axial diffusion nozzles and inclined diffusion nozzles are preferably provided. The axial diffusion nozzles are positioned on the radially outer side of the burner bottom and the inclined diffusion nozzles are positioned on the radially inner side of the burner bottom.

The axial diffusion nozzles and inclined diffusion nozzles can form two or more concentric circles whose common center lies on the longitudinal axis of the burner.

The diffusion nozzles can have different geometries. For example, the diffusion nozzles are formed as bore holes, grooves or longitudinal slits.

The pilot gas system preferably has more axial diffusion nozzles than inclined diffusion nozzles. In particular, twice as many axial diffusion nozzles as inclined diffusion nozzles can be provided.

In one embodiment, the premix burner is constructed as a can-shaped burner with an at least partially cylindrical flame tube which is at a distance from the burner bottom over the swirler.

BRIEF DESCRIPTION OF THE DRAWINGS

A preferred embodiment example of the invention is described more fully in the following with reference to schematic diagrams. In the drawings.

DETAILED DESCRIPTION OF THE PRESENTLY PREFERRED EMBODIMENTS

Figure 1:
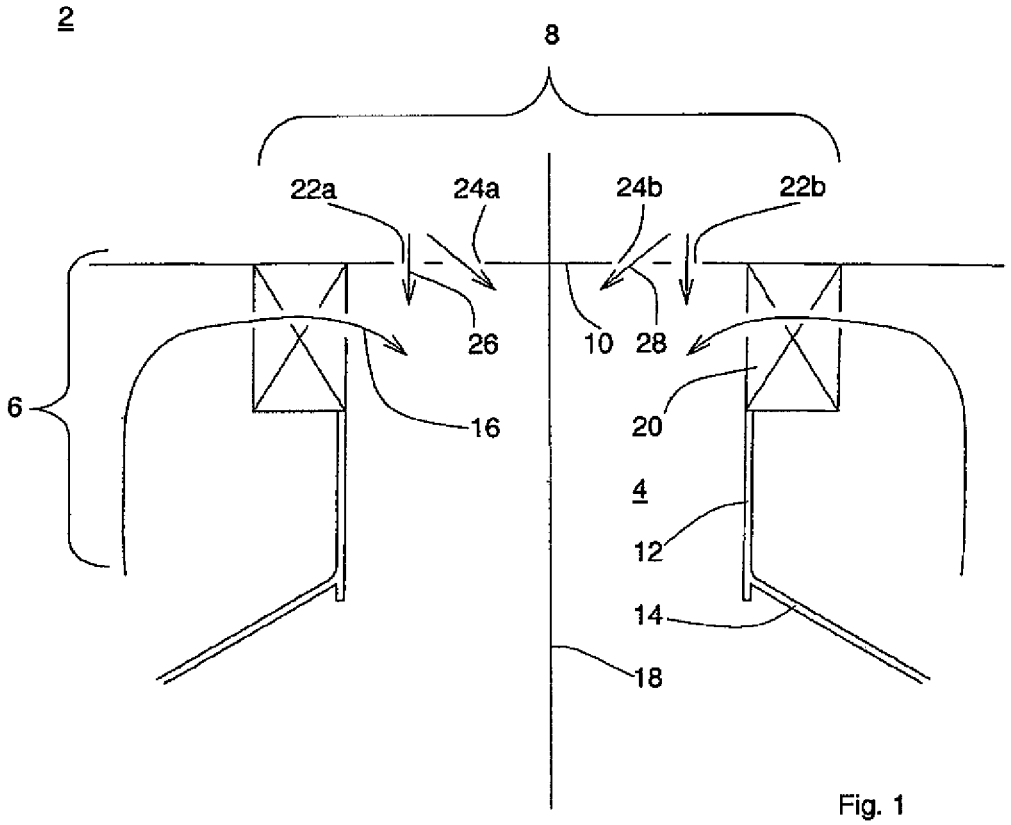
FIG. 1 is a longitudinal section through a premix burner according to the invention in the bottom region of the burner.

FIG. 1 is a highly simplified partial longitudinal section through a premix burner 2 according to one embodiment of the invention for a gas turbine. The premix burner 2 is constructed as a can-shaped burner with a cylindrical flame chamber 4 for gaseous or liquid fuel. It has a main injector 6 and a central multi-stage pilot gas system 8 according to one embodiment of the invention.

The flame chamber 4 is defined in axial direction on one side by a burner bottom 10 and radially by a flame tube 12. An end portion 14 of the flame tube 12 remote of the burner bottom 10 is widened in a funnel-shaped manner.

The main injector 6 serves to inject a gas-air mixture as premixed main fuel 16. The injection is carried out radially to the longitudinal axis 18 of the burner by main nozzles, not shown, which open into a radial swirler 20. The main injector preferably has main nozzles.

The radial swirler 20 is arranged between the burner bottom 10 and the flame tube 12. It causes the main fuel 16 to be acted upon by a swirling momentum and to enter the flame chamber 4 in a swirling manner. A main fuel flow whose direction is indicated by its respective arrows is formed in the flame chamber 4.

The pilot gas system 8 serves to inject a diffusion fuel which is not premixed and has a plurality of axial diffusion nozzles 22*a*, 22*b* and a plurality of diffusion nozzles 24*a*, 24*b* which are arranged at an inclination to the burner longitudinal axis 18. The diffusion fuel is injected into the flame chamber 4 by the axial diffusion nozzles 22*a*, 22*b* and the inclined diffusion nozzles 24*a*, 24*b* as two partial streams 26, 28.

The axial diffusion nozzles 22*a*, 22*b* and the inclined diffusion nozzles 24*a*, 24*b* are arranged in the burner bottom 10 so that an injection of the partial streams 26, 28 is carried out downstream of the entrance of the main fuel flow 16. The axial diffusion nozzles 22*a*, 22*b* transverse to or perpendicular to the flow direction of the main fuel 16 in the flame chamber 4 cause the first partial stream 26 to be mixed with the main fuel 16 in a particularly intensive manner. The inclined diffusion nozzles 24*a*, 24*b* are oriented in such a way that the second partial stream 28 is injected into the flame chamber 4 in the flow direction of the swirled main fuel 16 and the mixing is accordingly minimized, which promotes the stability of the combustion process.

Figure 2:
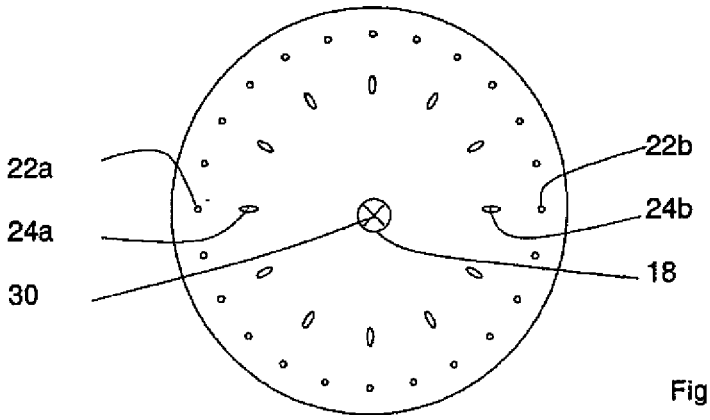
FIG. 2 is a top view of the burner bottom from FIG. 1.

According to the front view of the burner bottom 10 in FIG. 2, the axial diffusion nozzles 22*a*, 22*b*, 22*n* and the inclined diffusion nozzles 24*a*, 24*b*, 24*n* form two concentric circles whose common center 30 lies on the burner longitudinal axis 18. The axial diffusion nozzles 22*a*, 22*b*, 22*n* are accordingly positioned on the radially outer side and the inclined diffusion nozzles 24*a*, 24*b*, 24*n* are positioned on the radially inner side. The diffusion nozzles 22*a*, 22*b*, 22*n*, 24*a*, 24*b*, 24*n* are uniformly distributed over the respective circle. In the present embodiment, 24 axial diffusion nozzles 22*a*, 22*b*, 22*n* and 12 inclined diffusion nozzles 24*a*, 24*b*, 22*n* are provided. Accordingly, there are twice as many axial diffusion nozzles 22*a*, 22*b*, 24*n* as inclined diffusion nozzles 24*a*, 24*b*, 24*n*. The quantity of axial diffusion nozzles 22*a*, 22*b*, 24*n* corresponds to the quantity of main nozzles.

The axial diffusion nozzles 22 and the inclined diffusion nozzles 24 are formed as bore holes in this embodiment example.

In a preferred method according to the invention for operating the premix burner 2, a swirled gas-air mixture of the main injector 6 is injected radially into the flame chamber 4 via the radial swirler 20. A diffusion fuel is injected into the flame chamber 4 as a first partial stream 26 and a second partial stream 28 by the multi-stage pilot gas system 8. The first partial stream 26 is injected into the flame chamber 4 by the axial diffusion nozzles 22*a*, 22*b*, 24*n* and the second partial stream 28 is injected into the flame chamber 4 by the inclined diffusion nozzles 24*a*, 24*b*, 24*n*. The gas-to-air ratio of the main fuel 16 is adapted to the respective load state by changing the air supply to the main fuel 16. Accordingly, the gas-air mixture is not adapted by switching the main nozzles on and off in a known manner.

It is also conceivable to divide the diffusion fuel into more than two partial streams 26, 28. This application is also not confined to two identical or two different partial streams 26, 28 of the diffusion fuel stream.

Further, the geometry of the diffusion nozzles 22*a*, 22*b*, 24*a*, 24*b*, is not restricted to bore holes; rather, grooves or longitudinal slits are also conceivable. The geometry of the axial diffusion nozzles can also differ from that of the inclined diffusion nozzles. Further, the arrangement of the diffusion nozzles 22*a*, 22*b*, 24*a*, 24*b*, is not limited to a circular arrangement; rather, other arrangements such as, for example, a star-shaped configuration are also conceivable. A non-uniform distribution of the diffusion nozzles is likewise possible.

Herein disclosed are a method for operating a premix burner for gaseous fuels with a multi-stage pilot gas system, whose diffusion fuel is injected into a flame chamber of the premix burner as at least two partial streams with different orientations, and a premix burner for carrying out the method.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for operating a premix burner for gas turbines, comprising:

injecting a gas-air mixture into a flame chamber as main fuel via a swirler and a quantity of main nozzles;

injecting a first partial stream of a diffusion fuel centrally into the flame chamber radially inside the swirler by a quantity of first nozzles having a first orientation at an inclination to a longitudinal axis of the premix burner and arranged in a burner bottom radially between the longitudinal axis of the premix burner and the swirler and configured as one of a bore, a groove, and a longitudinal slit; and injecting a second partial stream of the diffusion fuel centrally into the flame chamber radially inside the swirler by a quantity of second nozzles having a second orientation arranged in the burner bottom parallel to the longitudinal axis of the premix burner and radially between the quantity of first nozzles and the swirler and configured as one of a bore, a groove, and a longitudinal slit, wherein the first orientation and the second orientation are different, and wherein the premix burner comprises twice as many second nozzles as first nozzles.

2. The method according to claim 1, wherein the second partial stream is injected substantially transverse to a flow direction of the main fuel flow in the flame chamber, and the first partial stream is injected substantially in the flow direction of the main fuel flow.

3. The method according to claim 2, wherein the main fuel is injected radially.

4. The method according to claim 3, wherein a gas-air ratio of the main fuel is controlled by an air supply.

5. The method according to claim 1, wherein a gas-air ratio of the main fuel is controlled by an air supply.

6. A premix burner for gas turbines comprising:

a flame chamber having a burner bottom;

a main injector having a number of main nozzles and configured to inject a gas-air mixture as a main fuel into the flame chamber as a main fuel flow;

a swirler configured to swirl the main fuel; and a central pilot gas system arranged in the burner bottom radially inside the swirler for injecting a diffusion fuel, comprising:

a plurality of inclined diffusion nozzles each arranged in the burner bottom radially between a longitudinal axis of the premix burner and the swirler and configured to inject a first partial stream of diffusion fuel at an inclination to the longitudinal axis of the premix burner; and a plurality of axial diffusion nozzles each arranged in the burner bottom radially between the plurality of inclined diffusion nozzles and the swirler and configured to inject a second partial stream of the diffusion fuel parallel to the longitudinal axis of the premix burner and transverse to the main fuel flow in the flame chamber; and, wherein the plurality of axial diffusion nozzles and the plurality of inclined diffusion nozzles have different orientations, wherein each of the axial and inclined diffusion nozzle is configured as at least one of a bore, a groove, and a longitudinal slit, and wherein there are twice as many axial diffusion nozzles as inclined diffusion nozzles.

7. The premix burner according to claim 6, wherein each of the plurality of inclined diffusion nozzles is inclined with respect to the flow direction of the main fuel flow.

8. The premix burner according to claim 7, wherein:

the plurality of axial diffusion nozzles are a plurality of radially outer axial diffusion nozzles; and the plurality of inclined diffusion nozzles are a plurality of radially inner inclined diffusion nozzles, the plurality of inner nozzles inclined with respect to the flow direction of the main fuel flow.

9. The premix burner according to claim 8, wherein the plurality of axial diffusion nozzles and the plurality of inclined diffusion nozzles are arranged in two concentric circles whose common center lies on the longitudinal axis of the premix burner.

10. The premix burner according to claim 9, wherein the plurality of axial diffusion nozzles have a different geometry than the plurality of inclined diffusion nozzles.

11. The premix burner according to claim 6, wherein at least one axial diffusion nozzle of the plurality of axial diffusion nozzles has a different geometry than at least one inclined diffusion nozzle of the plurality of inclined diffusion nozzles.

12. The premix burner according to claim 11, wherein the at least one axial diffusion nozzle and the at least one inclined diffusion nozzle are configured as bore holes.

13. The premix burner according to claim 6, wherein the flame chamber is radially defined in a vicinity of the burner bottom by the swirler and by a cylindrical flame tube.

14. The premix burner according to claim 6, wherein the number of main nozzles corresponds to a quantity of first nozzles.

* * * * *